United States Patent [19]

Coulter et al.

[11] 4,425,385

[45] Jan. 10, 1984

[54] METHOD FOR CLEANING AND COATING PIPELINE WALLS

[75] Inventors: James H. Coulter, Houston, Tex.; David L. Lindsey, Oklahoma City, Okla.

[73] Assignee: Coulter-Mustang Services Company, Houston, Tex.

[21] Appl. No.: 367,341

[22] Filed: Apr. 12, 1982

[51] Int. Cl.[3] ..... B05D 7/22; B05D 1/26; B05D 1/40; B05D 1/36

[52] U.S. Cl. ..... 427/238; 427/230; 427/235; 427/239

[58] Field of Search ..... 427/230, 238, 239, 235

[56] References Cited

U.S. PATENT DOCUMENTS 3,112,227 11/1963 Curtis .
4,069,535 1/1978 Cato .
4,081,875 4/1978 Nishino .
4,122,575 10/1978 Sagawa .
4,174,750 11/1979 Nichols .

*Primary Examiner*—James R. Hoffman
*Attorney, Agent, or Firm*—Laney, Dougherty, Hessin & Beavers

[57] ABSTRACT

A method for distributing fluid along the interior wall of a pipeline wherein a quantity of fluid is placed at a location in the pipeline and exposed at one side to a force acting in an axial and rotational direction. This force will cause at least a portion of the fluid to enter a helical path adjacent the pipeline which will force the material to be coated on the inner wall of the pipeline. As the fluid is coated on the pipeline wall it is exposed to an axial wiping force which smooths out the fluid coated onto the inner wall of the pipeline by removing the excess material.

6 Claims, 5 Drawing Figures

METHOD FOR CLEANING AND COATING PIPELINE WALLS

BACKGROUND OF THE INVENTION

1. Field of the Invention

This invention relates generally to methods and apparatus for cleaning and coating pipeline walls, and in one particular aspect, but not by way of limitation, to pipeline pigs adapted to be propelled through a pipeline, such as an oil or gas pipeline, by a pressure gradient.

2. Brief Description of the Prior Art

Various devices and methods have been used to internally apply cleaning and coating materials to pipe walls. Many of these devices are unsuccessful in coating all portions of the pipeline wall. Those methods and devices which do enjoy some level of success at coating all portions of the pipe are expensive to use because of the excess amount of coating material that is wasted in the effort to assure that all portions of the pipe have been coated. Some methods waste 50% of the coating material as compared to the amount of material that would be necessary to do the job satisfactorily.

A customary pipeline coating technique now in use is to provide a pair of spaced pipeline pigs which define between them a space axially extending in the pipeline and blocked at each end by the spaced pigs. Pressure is applied to the trailing pig to drive the paired pigs through the pipeline with a liquid used for coating the pipeline placed in the space in between. At times, the leading pig will tend to run away from, or move faster through the pipeline than, the trailing pig. When this happens, the liquid between the two pigs does not completely fill the intervening space, and the result is that there are holidays left on top of the pipeline where the liquid does not contact it and effectively coat the pipeline.

In attempting to regulate the speed of a pig to prevent it from running too fast, pressure is built in front of the pig and held as a back pressure. A greater pressure is applied to the back (or rear end) of the pig so that the pig moves forward in response to the forward force resulting from the pressure gradient between the rear and the front of the pig. The use of this technique to drive pipeline pigs has also resulted in the unsatisfactory coating of pipeline walls because when this technique is used to propel a pipeline pig through the pipeline, there is a tendency for the pig to tilt forward. When the pig is so tilted, it loses contact with part of the pipeline wall, thus preventing the uniform coating of that wall.

A discussion of all the prior art in this area would be prolix and prohibitively long; therefore, only the most pertinent patents will be discussed.

U.S. Pat. No. 3,112,227 to Curtis shows a rotary device used for applying paint or other protective compounds to the interior of conduit. The device is mechanically driven through the conduit by the use of an elongated tubing and the rotary force is also applied by means of a torque or rotating force applied to this tubing attached to one end of the rotary device used for applying the coating. The coating material is directed through the hollow interior of the driving tube to a central body, and from this body the coating material is distributed outwardly through radial pores formed in the center portion of the body.

U.S. Pat. No. 4,069,535 to Cato discloses a pipeline pig composed of an elongated cylindrical body with a front end and a rear end, and including a plurality of spaced, annular, flexible rings traversing the cylindrical body. The Cato patent also discloses a pig with a hollow interior which is open at the rear end to allow fluid or gas under pressure to enter the pig. Therefore when the pig is placed in a pipeline and pressure is applied behind the pig, it is driven down the pipeline.

U.S. Pat. No. 4,081,875 to Nishino discloses a scale removal device for scraping off scale deposits on the inner surface of a pipe. The device includes a rotary shaft which is positioned within the tube for advancement and rotation under the action of fluid under pressure pumped into such pipe. The rotary shaft includes a spiral blade extending along a substantial length of the shaft. Fluid is pumped against the device, causing forward thrust and making the shaft rotate. The rotation of the shaft thereby causes the spiral blade to scrape against the pipe, producing the cleaning action desired. The spiral blade and the inner wall of the pipe are so positioned that fluid or other liquid may pass between the blade and the pipe.

U.S. Pat. No. No. 4,175,750 to Nichols also relates to a tube cleaner. The Nichols tube cleaner includes a spirally configured member which is caused to rotate to clean the tube's interior walls. This device also allows fluid to pass through the pipeline past the device and the interior walls.

U.S. Pat. No. 4,122,575 discloses a tube cleaning device which has a compressible elastic body made of material such as polyurethane. This material has at least one spiral groove formed in its periphery running from the front to the rear side or end of the body. When a force resulting from a pressure gradient is applied to the material, a thrusting force is applied to the inclined surface of the spiral groove, causing the device to rotate.

As can be seen, the prior art has developed devices which usually require the use of either a force resulting from a pressure gradient or an external rotary force so that they may be propelled down the pipeline. As previously discussed, the use of a force resulting from a pressure gradient to propel a pig results in an unsatisfactory coating of the pipeline walls. The use of external rotary force, as can be appreciated, severely limits the types of pipeline wall coating tasks that can be undertaken. Only the Cato patent discloses a pipeline pig which utilizes pressure acting interiorly of a pig to facilitate movement through the pipeline, thereby avoiding some of the problems created by the designs of the prior art. The Cato patent, however, in contrast to the present invention, locates a plurality of annular rings along the elongated body of the pig. This design requires the user to utilize an excessive amount of material if he wishes to insure that all portions of the pipeline wall are coated. This is so because the annular rings only act to smooth the material onto the pipeline walls, and therefore require a column of material in front of them which contacts all portions of the wall if the entire wall is to be coated. In contrast, the present invention utilizes helically oriented flights which will pick up material from the bottom of the pipeline and will carry the material to all areas of the pipe. Not only does this design save the manufacturer material and therefore money, but it also facilitates the uniform coating of pipelines in areas where the prior art was previously unsuccessful. Because of the construction of a pipeline, and the topography in which it is often laid, there are times when a full column of coating material cannot be supported by the pipeline coating devices and therefore portions of the pipeline wall are not coated. The present invention, because of its design, can uniformly coat a pipeline wall, even if a minimal amount of coating material is present.

SUMMARY OF THE INVENTION

It is accordingly an object of the present invention to provide an improved pipeline pig for cleaning and coating pipeline walls.

It is also an object of the present invention to provide a pipeline pig which allows the user to insure that all portions of the pipeline wall are coated without having to use an excessive amount of coating material.

Another object of this invention is to provide a pipeline pig which utilizes interior pressure to facilitate movement of the pig through the pipeline and to insure the sealing engagement of the pipeline wall and the pig.

Still another object of this invention is to provide a pipeline pig with a smoothing flange to insure a uniform thickness of material coated on the wall of the pipeline.

A further object of the present invention is to provide a pipeline pig with a back sealing flange to prevent the flow of material in the pipeline from the back end of the pig to the front end.

It is also an object of the present invention to provide a pipeline pig with helically oriented flexible flights which carry material in the pipeline toward the back of the pig where it is uniformly coated on the walls of the pipeline, and which flights further aid in maintaining a constant axial velocity of the pig as it is moved through the pipeline.

It is also an object of the present invention to provide an improved method for distributing fluid along the interior wall of a pipeline.

The pipeline pig of this invention is adapted to be propelled through a pipeline by a pressure gradient, and has an elongated flexible body with a front end and a rear end. Helically oriented flights circumscribe the body from the front end to a point relatively near the rear end. The helically oriented flights are preferably constructed so that they define a double helix. The body of the pig contains a central aperture or bore extending from the front end to the rear end. An opening is defined in the rear end communicating with the central aperture and allowing fluid under pressure to enter the aperture. In a preferred embodiment, the body also contains an annular ring spaced between the helically oriented flights and the rear end which acts as a smoothing flange.

The pipeline pig is so constructed and arranged that during its utilization, its flights, annular ring and rear end sealingly engage the inner wall of the pipeline.

Another aspect of the invention is an improved method for distributing fluid along the interior wall of a pipeline. To this end a quantity of fluid is placed at a locus in the pipeline. A force is then exerted on one side of the fluid in an axial and rotational direction. This force will cause at least a portion of the fluid to enter a helical path adjacent to the pipeline. Fluid so subjected to this force is then coated on the inner wall of the pipeline. As the fluid is coated onto the inner wall it is exposed to an axial wiping force. The wiping force acts to smooth out the coated fluid to a uniform thickness around the inner wall of the pipeline by wiping away the excess fluid, thereby insuring that the inner wall of the pipeline is totally and uniformly coated with the fluid.

DETAILED DESCRIPTION OF PREFERRED EMBODIMENTS OF THE INVENTION

Figure 1:
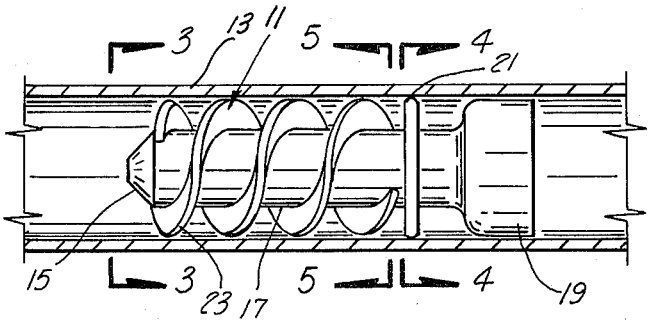
FIG. 1 is a view showing the pipeline pig of the present invention located in a pipeline.
Figure 2:
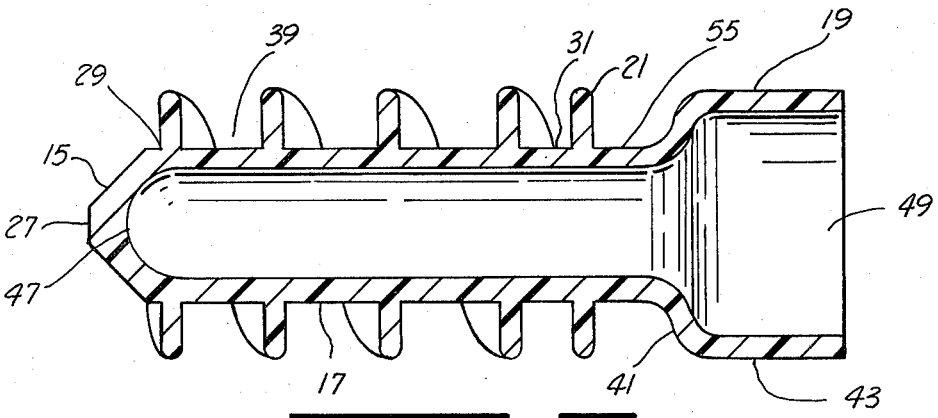
FIG. 2 is a longitudinal cross-sectional view of the pipeline pig.

Referring to FIGS. 1 and 2, the pipeline pig is shown generally at 11 in pipeline 13. The pig 11 includes a front end 15, a cylindrical body 17, a rear ene 19, an annular ring 21, and resilient, flexible flights 23. The pig 11 is of an elongated cylindrical shape with the rear end 19 being of a larger diameter than the cylindrical body 17 which is of a larger diameter than the front end 15. The pig 11 is preferably made of urethane or some other resilient, flexible material capable of bending and allowing the pig to negotiate bends and turns when propelled through the pipeline 13.

The front end 15 defines the frustum of a cone with the base of the cone being provided by the cylindrical body 17. The front end 15 includes sides extending from cylindrical body 17 to a terminus where they define the blunt nose 27 of the pig 11. The blunt nose 27 is generally of a diameter much smaller than the rear end 19 and approximately a quarter of the diameter of the cylindrical body 17. This design helps facilitate movement of the pig 17 through the pipeline 13 by allowing the front end 15 to define a path of movement, and the pig 11 can easily traverse a pipeline 13 even though a viscous fluid in the pipeline must be negotiated.

Helically oriented flexible flights 23 traverse the cylindrical body 17 of the pig 11 from a point 29 on the cylindrical body 17 to a point 31 on said same cylindrical body 17. The helically oriented flexible flights begin at point 29 which is located just to the rear of the front end 15. The front end 15 therefore has a smooth surface without protruding helically oriented flights. When a frontal view of the pig is taken, as in FIG. 3, the front end therefore appears to be bullet shaped. This design further facilitates movement of the pig by better allowing the front end 15 to define a path of movement. Two helically oriented flexible flights 23 define a double helix traversing said pig 11 from point 29 to point 31. The flights 23 are of the same pitch and orientation with respect to the cylindrical body 17. As shown in FIG. 2, when a cross-section of pig 11 is taken, flights 23 define right angles to the cylindrical body 17. Furthermore, flights 23 are oriented so that a plane passed through the pig 11 perpendicular to the longitudinal axis will intersect sections of each of the flights which are disposed 180° from each other around the cylindrical body 17.

Figure 3:
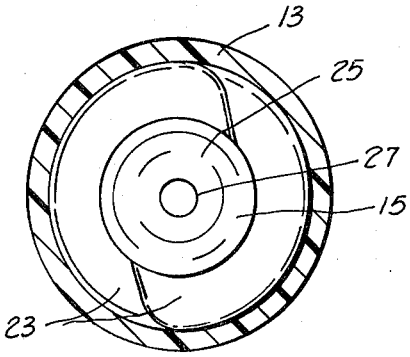
FIG. 3 is a cross-sectional view of the pipeline pig and the pipeline taken along line 3—3 of FIG. 1.

The flights 23 extend radially from the cylindrical body 17 as shown in FIG. 2. The radial height of these flights 23 is at least as great as one-half the radius of the cylindrical body 17. The pipeline 13 is of such a diameter that when the pipeline pig 11 is placed in said pipeline 13, as shown in FIG. 3, the flights 23 are in contact with the pipeline wall.

The space 39 between the two flights 23 on any side of the cylindrical body 17 is equal to, or greater than, the radial height of each flight 23. As can be seen in FIGS. 1 and 3, flights 23 begin to traverse the body 17 near the front end 15 of the pig 11, and space 39 therefore defines a helical or path zone through which a coating fluid in the pipeline may pass when the pig 11 is propelled through the pipeline 13, thereby simultaneously exerting both an axial and a rotational force upon such fluid when it is positioned ahead of the moving pig. As the pig 11 moves through the pipeline 13, the helical orientation of the flights 23 causes the pig 11 to rotate. The rotation of the pig helps keep the pig moving at a constant speed, allowing the pig 11 and the column of material to move as one unit through the pipeline 13. Rotation of the pig causes material in the pipeline to be rotated down the pig 11 through spaces 39. Even if conditions are such that the pig 11 is unable to rotate, material in the pipeline 13 will still auger up the helically oriented flights 23 through space 39 when the pig is propelled through the pipeline. Therefore if the pig 11 goes forward the material must spiral upwardly.

Flights 23 are made of a flexible material allowing them to negotiate bends and twists in the pipeline 11. Said flights 23 are also resilient, allowing them to resume their shape after negotiating such bends, and therefore allowing them to always contact the pipeline walls if the pipeline 13 does not substantially increase in diameter.

Figure 4:
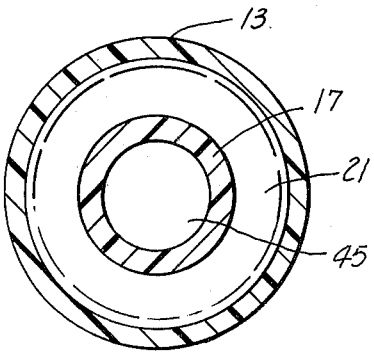
FIG. 4 is a cross-sectional view of the pipeline pig and the pipeline taken along line 4—4 of FIG. 1.

Located at a position between the end of the flexible flights 31 and the rear end 19 of the pig is the annular ring 21 which circumvolves the cylindrical body 17. The annular ring 21 lies in a plane which extends at a right angle to the cylindrical body 17 when a cross-sectional view of the pig 11 is taken as shown in FIG. 2. Also, as shown in FIG. 2, the annular ring 21 extends from the cylindrical body 17 to a radial height substantially equal to the flights 23. Therefore, as can be seen in FIG. 4, the annular ring 21 also contacts the wall of the pipeline 13 when the pig 11 is placed in the pipeline. The annular ring 21, like the flights 23, is made of a flexible, resilient material allowing it to bend and contract. A cross-sectional view of the annular ring 21 also discloses that it is of an axial width which is preferably equal to, or greater than, the axial width of the flexible flights 23.

The rear end 19 is of a diameter substantially equal to that of the annular ring 21 and flexible flights 23. Therefore, when the pipeline pig 11 is placed in the pipeline 13, the rear end 19 is preferably in contact with the pipeline walls 14. The rear end 19 thereby acts as a sealing flange preventing the flow of material from the rear end 19 of the pig 11 toward the front end 15 thereof along the outer side of the cylindrical body 17.

The rear end 19 is defined by a tapered throat 41 and an enlarged region 43. The tapered throat 41 extends from the cylindrical body 17 to the enlarged region 43. The enlarged region 43 is of a substantially greater axial length than the axial width of the annular ring 21.

The rear end 19 is also constructed of a flexible, resilient material allowing it to deform and regain its original shape. When placed in the pipeline 13 the pig 11 therefore contacts the pipeline wall at the flexible flights 23, the annular ring 21 and the rear end 19.

Figure 5:
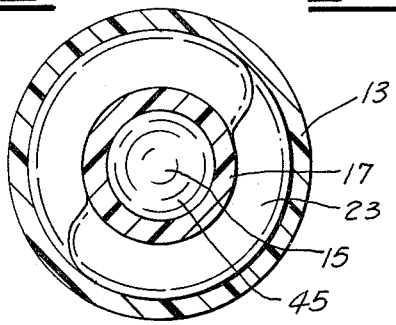
FIG. 5 is a cross-sectional view of the pipeline pig and the pipeline taken along line 5—5 of FIG. 1.

The cylindrical body 17 contains a central bore or aperture 45. The central aperture 45 extends from a point 47 at the base of the front end 15 to the rear end 19 of the pig. The rear end 19 of the pig 11 defines an opening 49 to the central aperture 45. The diameter of the opening 49 is at least equal to the diameter of the cylindrical body 17. As shown in the cross-sectional view of FIG. 4, the central aperture 45 is in communication with the interior of the pipeline at the rear end 19. The overall shape of the central aperture 45 is similar to the overall shape of the pig 11. Therefore, the part of the central aperture 45 defined by the rear end 19 has the shape of the rear end, while the remainder of the central aperture 45 is cylindrically shaped like the cylindrical body 17. When a cross-section is taken of the pig and viewed from the rear, as in FIG. 5, the central aperture 45 can be seen extending to the front end 15. Stated differently, the interior of the pig 11 is hollow.

The walls of the cylindrical body 17 are preferably constructed of a material impervious to the flow of fluid therethrough. When fluid under pressure is passed through the pipeline 13 behind the pig 11, it will enter the central aperture 45 through the opening 49. The pressure of the fluid will cause the flexible pig 11 to expand, thereby forcing the annular ring 21, flexible flights 23 and rear end 19 to sealingly engage the pipeline wall. When the pig 11 is so positioned, the bulk flow of free fluid through the pipeline 13 past the annular ring 21 or rear end 19 is prevented. Furthermore, the pressure in central aperture 45 will cause the pig to be propelled through the pipeline 13. The internal pressure, caused by the flow of fluid into the central aperture 45, will by symmetrically distributed to all points of the pig 11. The internal pressure will thereby keep the pig 11 centralized in the pipeline 13 as it is propelled. This is in contrast to pigs lacking a central aperture 45 which are pushed from the back by pressure gradients. Such a method of propulsion tends to cause the pig to tilt forward and downward, thereby causing part of the pig to lose contact with the wall of the pipeline 13. In contrast, the central aperture 45 not only allows the fluid under pressure to provide an axial propulsive force to the pig, but also allows said fluid to exert radial forces normal to the axis of the cylindrical body 17, thereby causing the flexible pig 11 to radially expand and sealingly engage the pipeline wall with greater tenacity. The cylindrical body walls of the pipeline pig 11 are of a thickness which is selected to allow them to expand under fluid pressure, yet affords the pig 11 needed strength and stability. In the expanded state, the helically oriented flights 23, annular ring 21 and rear end 19 sealingly engage the inner wall of the pipeline 12. When so engaged, fluid may not pass between the flexible flights and the pipeline wall. Therefore, when fluid is in front of the pipeline pig 11 and pressure is applied to the central aperture 45, the pig will be caused to rotate through the fluid, causing the fluid to pass through spaces 39 from the top of the pig 15 to the rear of the pig 19. This rotation of the pig 11 not only tends to impart constant velocity to the pig, but also causes the fluid to be spread evenly across the wall of the pipeline 13. Consequently, even if material is placed only in the bottom of the pipeline 13, it will be carried to all areas of the pipeline by the flexible flights 23. This is in contrast to pigs without helically oriented flights which generally fail to distribute the material to all points on the wall of the pipeline.

Once fluid under pressure enters the central aperture 45, and the annular ring 21 sealingly engages the pipeline 13, the bulk flow of free fluid through the pipeline past the annular ring 21 is prevented. The annular ring 21 acts as a smoothing flange, allowing only material coated on the pipeline wall to remain behind once the annular ring 21 has passed a point on the pipeline 13.

The ring 21 thereby prevents the waste of coating material, as only material which has coated the pipeline 13 is allowed to pass by the ring 21. The rest of the material is continually pushed forward and exposed to the pipeline wall allowing it to be coated thereon. The sealing engagement of the annular ring 21 also helps smooth out any material coated on the pipeline wall by scraping off any excess material on the wall. To this end, the width of the annular ring 21 may be varied depending on the material used and the thickness of the coating desired.

The rear end 19, which also sealingly engages the pipeline wall at its enlarged region 43 when fluid under pressure enters the central aperture 45, acts as a sealing flange. The rear end 19 prevents the propulsive or driving fluid from flowing from the back of the pig 11 to the front end 15 of the pig. Because of the axial length of the enlarged region 43, and the rotational movement of the pig 11, the rear end 19 also insures that the material coated on the pipeline 13 will have a uniform thickness. A space 55 between the ring 21 and the rear end 19 provides a void into which may fall and collect, material which has dripped off the pipeline wall after the annular ring 21 has passed. Therefore only a minimal amount of material will be removed by the rear end 19, preventing a build-up of material on the enlarged region 43 which might cause the enlarged region to lose its sealing engagement with the pipeline wall. The space 55 also effectively provides a "hinge point" facilitating flexure or bending of the pig as needed to traverse a sharp bend in the pipeline, since this space is seldom completely filled with fluid, which in the case of liquids would be substantially incompressible and unyielding.

In one mode of use, a first pipeline pig 11 is placed at the location desired to be painted. Behind the first pig 11 is placed the painting material. Pressure applied through this material to the pig will cause the lead pig 11 to rotate through the pipeline 13. Pressure exerted by the painting material when it enters the central aperture 45 will also cause the pig 11 to more tenaciously sealingly engage the wall of the pipeline 13, preventing the painting material from passing the lead pig 11. A second pig 11 is then placed behind the lead pig 11 and painting material. Pressure is applied behind the second pig 11, causing it to rotate and move axially in the pipeline 13. The second pig 11 sealingly engages the wall of the pipeline 13 and exerts pressure on the painting material. As the second or trailing pig 11 rotates through the painting material, the material is forced through spaces 39 between the helically oriented flights 23 and coated on the wall of the pipeline 13. The annular ring 21 smooths out the material coated on the wall of the pipeline 13 and prevents the free flow of the material to the rear end 19 of the second pig 11. The rear end 19 then acts to insure uniform thickness of the material by passing over the material.

Depending on the application, one may wish to place first one pig 11, then a column of material, a second pig, another column of material, then a third pig. This system would thereby put two coats of material on the wall of the pipeline 13 with one operational pass through the pipeline. It should also be noted that if desired, a single pig 11 can be used alone to coat the wall of the pipeline. This can be accomplished by first placing a quantity of coating material in the pipeline 13 and then the pig 11.

The pipeline pig 11 may also be used to clean the interior of a pipeline 13. To this end a cleaning fluid may be applied to the wall of the pipeline 13 by the pig 11, or as can easily be seen, certain forms of the pipeline pig of the invention can be forced through a pipeline 13 without any cleaning fluid, relying only on its flights, annular ring and rear end to scrape off any debris that has accumulated on the wall of the pipeline.

The pig 11 is constructed as one unit. All flights 23 and the annular ring 21 are integrally molded with the cylindrical body 17 of the pig 11. This affords a construction in which no part can become lost or fall off the pig.

Thus, the pipeline pig of the present invention is well adapted to attain the objects and advantages mentioned above as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A method for distributing fluid along the interior wall of a pipeline comprising:

placing a quantity of fluid to be distributed at a location in the pipeline;

exerting a force on one side of the quantity of fluid concurrently in an axial and rotational direction in the pipeline so as to cause at least a portion of that fluid to move through a helical path adjacent the pipeline so fluid subjected to that force is coated on the inner wall of the pipeline; and smoothing the fluid contacted with the inner wall of the pipeline by movement through the helical path by wiping any excessive fluid with an axial wiping force substantially equally applied to the fluid around the inner wall of the pipeline concurrently with the application of axial and rotational force.

2. The method of claim 1, whereby the method is accomplished by:

placing a pipeline pig on one side of said quantity of fluid, with said pipeline pig having helically oriented flights and a hollow interior; and forcing said pipeline pig into said quantity of fluid.

3. A method for distributing fluid along the interior wall of a pipeline comprising:

placing in the pipeline a quantity of fluid to be distributed;

placing a hollow pipeline pig carrying helically oriented flights at one side of the fluid;

propelling the pipeline pig against the fluid by use of internal pressure applied to the interior of the pig; and causing the fluid to be received in the spaces between said helically oriented flights on the pig and thereby rotatably distributed to all portions of the inner wall of the pipeline as the pig is propelled against the fluid.

4. The method according to claim 3, including the additional steps of:

smoothing out to a uniform thickness the material coated on the wall of the pipeline concurrently with the movement of the pig through the pipeline.

5. The method according to claim 4, including the additional steps of:

placing an additional quantity of fluid to be distributed in the pipeline on the opposite side of said first-mentioned pig from said first-mentioned quantity of fluid;

placing a second, hollow pig carrying helically oriented flights on the opposite side of said second-mentioned quantity of fluid; and propelling the pipeline pigs through the pipeline so that they rotate through the material and move at a constant axial speed, and the material and pigs move as a unit.

6. The method according to claim 5, including the additional steps of:

sealingly engaging the pipeline wall with said first-mentioned pig to thereby prevent the flow of said second-mentioned quantity of fluid past said first-mentioned pig.

* * * * *